US007335009B2

(12) United States Patent
Lee

(10) Patent No.: US 7,335,009 B2
(45) Date of Patent: Feb. 26, 2008

(54) ROLLER MOLD PRESS

(76) Inventor: Chia Shun Lee, P.O. Box 44-2049, Taipei (TW) 10668

( * ) Notice: Subject to any disclaimer, the term of this patent is extended or adjusted under 35 U.S.C. 154(b) by 153 days.

(21) Appl. No.: 11/280,236

(22) Filed: Nov. 17, 2005

(65) Prior Publication Data

US 2006/0172030 A1 Aug. 3, 2006

(30) Foreign Application Priority Data

Feb. 3, 2005 (TW) ..... 94202027 U

(51) Int. Cl.
*B26D 7/27* (2006.01)

(52) U.S. Cl. ..... 425/298; 83/569; 83/860; 100/176; 425/363; 425/472

(58) Field of Classification Search ..... 425/363, 425/411, 472, 298; 100/172, 176; 101/6, 101/23, 24; 83/566, 569, 860
See application file for complete search history.

(56) References Cited

U.S. PATENT DOCUMENTS 1,252,822 A * 1/1918 Lorioli ..... 425/294
5,647,260 A * 7/1997 Nabity ..... 83/566
5,961,779 A * 10/1999 Bradshaw ..... 100/176
2005/0253324 A1* 11/2005 Corcoran et al. ..... 271/15

FOREIGN PATENT DOCUMENTS

GB 2067120 * 7/1981
JP 5-310000 * 11/1993

* cited by examiner

*Primary Examiner*—James P. Mackey
(74) *Attorney, Agent, or Firm*—Mark A. Mersereau; Nikolai & Mersereau, P.A.

(57) ABSTRACT

A detachable roller mold press includes two rollers that can rotate relative to each other. The rollers are securely fastened to a predetermined location, which can drive a press mold or a knife mold plate. The roller mold press of the present invention is detachable so as to save storage space. The detachable roller mold press includes a roller mechanism, a chassis, a bottom cover and two bridges. The roller mechanism includes two rollers that can rotate relative to each other. The front and the rear portions of the chassis include an opening. The opening and the two rollers form a space for allowing a knife mold or a press mold plate to move therein. By rotating the two rollers, one can move the knife mold or the press mold plate to rapidly carve or engrave on a piece of paper or a piece of cloth.

5 Claims, 6 Drawing Sheets

ROLLER MOLD PRESS

BACKGROUND OF THE INVENTION (1) Field of the Invention

The present invention relates generally to a roller mold press and, more particularly, to a detachable roller mold press that includes two rollers affixed to predetermined positions, which can drive the punch mold or the knife mold plate to continuously cut, carve and engrave the working materials.

(2) Description of the Prior Arts

Paper and cloth are the most commonly used working materials for making handicrafts. In addition to the various colors of the working materials, one can use a knife or a pair of scissors to cut the materials into different shapes. Not only is this production process time and labor consuming, an inexperienced crafter might not be able to cut out the expected shapes.

One conventional roller mold press disclosed in Taiwanese Published New Utility Patent No. 463701 is provided to solve the aforementioned problem. The conventional roller mold press includes a base plate, a magnetic plate, one or more knives, a frame assembly and a roller member. The roller member includes a roller shaft, two positioning connectors, an axial shaft, two gliding pieces, a plurality of ball bearings and a control element. In this manner, the roller member can reciprocate between the front and the rear frame assembly on the base plate, thereby cutting the paper disposed on the mold press to a predetermined shape.

However, such a conventional roller mold press still comprises many disadvantages. For example, the roller shaft moves relative to the paper mold, that is the paper mold is static while the roller shaft is moving. Therefore, the size of the paper applicable in the mold press depends solely on the space between the front and rear frame assembly. For paper of different sizes, the frame assembly can not securely affix the paper on the mold press. Further, the existence of the frame assembly renders the conventional roller mold press to require a larger occupation of space. Thus, the conventional roller mold press requires a larger operating space and a larger storage space. Moreover, the limited length of the frame assembly does not allow a continuous manufacturing process.

Accordingly, the inventor of the present invention has devoted himself to develop possible solutions for the drawbacks mentioned above. Finally, a new roller mold press is developed.

SUMMARY OF THE INVENTION

In light of the above, one objective of the present invention is to provide a detachable roller mold press that includes two rollers. The rollers are securely fastened to a predetermined location and can rotate relative to each other. The rollers can drive a punch mold or a knife mold plate to move on the roller mold press so as to continuously cut and press on materials of unrestricted length without enlarging the size of the roller mold press.

Another objective of the present invention is to provide a roller mold press that is detachable, so as to reduce the storage space and to lower the efforts of maintenance and repair.

In order to achieve the above and other objectives, the detachable roller mold press of the present invention includes a roller mechanism, a chassis, a bottom cover and two bridges. The roller mechanism includes two rollers that can rotate relative to each other. The rollers are properly separated with each other and are securely fastened to a predetermined location. The roller mechanism is covered with the chassis. An opening is formed on the front portion and the rear portion of the chassis. The openings correspond to the separation of the two rollers. The space between the two rollers and the openings on the chassis form a passageway, which allows a punch mold or a knife mold plate to penetrate therethrough. The bottom cover covers the lower portion of the roller mechanism. The bottom cover also securely fastens the roller mechanism to the chassis. The two bridges are assembled to the front and the rear portions of the chassis, respectively. By rotating the rollers, one can drive the knife mold or the punch mold plate to move forward and backward in the passageway. By continuously rotating the rollers, one can continuously drive the knife mold or the punch mold plate and press on the knife mold or the punch mold plate.

The roller mechanism further includes a static station, a rotating element, a transmission gear set, a first passive gear and a second passive gear. The static station includes an empty space that penetrates through the static station. The two rollers are then disposed on the static station. The rotating element is disposed to one side of the static station. The transmission gear set is composed of a plurality of gears. The initial transmission gear of the transmission gear set is engaged with the rotating element. The terminal transmission gear is engaged with the first roller. By turning the rotating element, one can drive the transmission gear set to rotate the first roller. These gears include small gears and large gears engaged with the small gears, such that only a smaller driving force is needed. Since an insufficient driving force will render insufficient cut and press due to the thickness differences of the knife mold or the punch mold plate, the incorporation of small gears and large gears can provide the necessary driving forces, without requiring the user to exert too much force. Therefore, one can continuously cut, carve and engrave on the working materials.

DETAILED DESCRIPTION OF THE PREFERRED EMBODIMENTS

The primary features and characteristics of the present invention are described in detail in the following specific embodiments. Any person having ordinary skill in the art would readily understand the technical features and advantages of the present invention. In addition, the present invention can be realized in different particular embodiments. All such modifications and alterations without departing from the spirit of the present invention are considered within the scope of the present invention.

Figure 1:
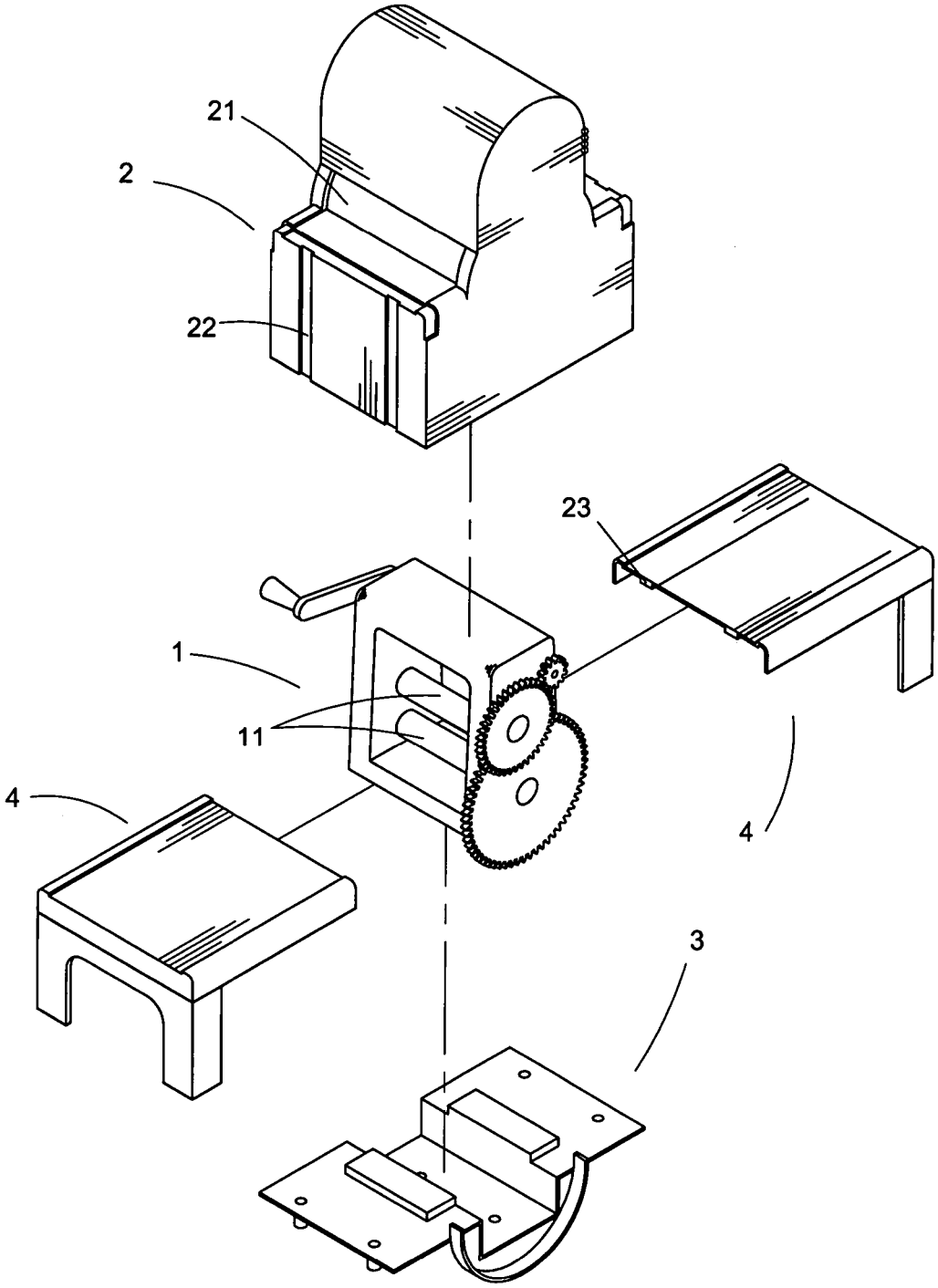
FIG. 1 is an explosive view illustrating a roller mold press in accordance with one preferred embodiment of the present invention.
Figure 3:
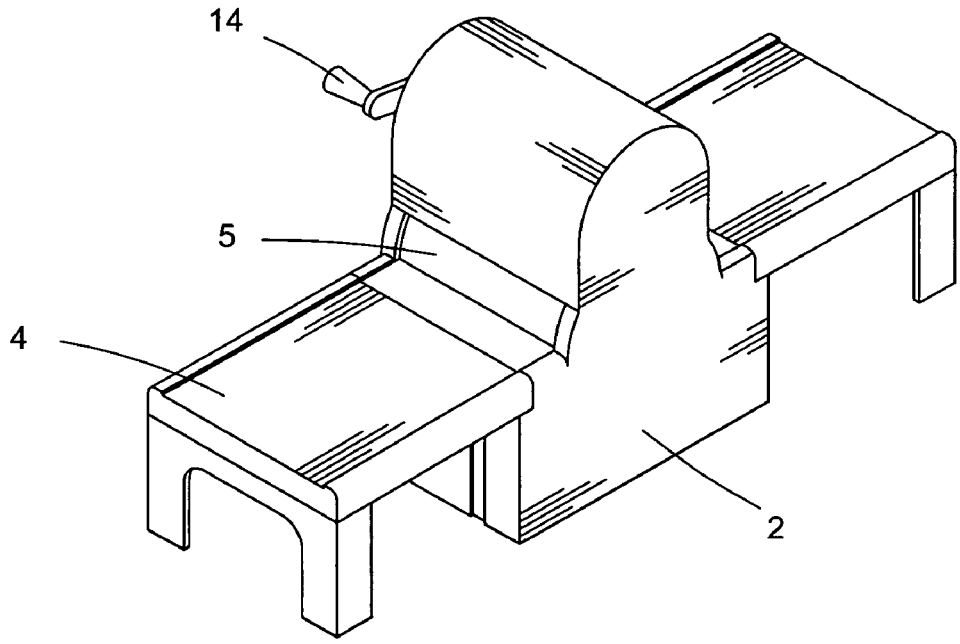
FIG. 3 is a perspective view illustrating the roller mold press in accordance with one preferred embodiment of the present invention.

Referring to FIG. 1 and FIG. 3, a roller mold press in accordance with a preferred embodiment of the present invention is illustrated. As shown, the detachable roller mold press includes a roller mechanism 1, a chassis 2, a bottom cover 3 and two bridges 4. The roller mechanism 1 includes two rollers 11, which are the first roller 111 and the second roller 112. The two rollers 11 can rotate relative to each other. A space 12 is formed between the first roller 111 and the second roller 112. The roller mechanism 1 is covered with the chassis 2. Both the front portion and the rear portion of the chassis 2 include an opening 21. The opening 21 is formed corresponding to the space 12 between the two rollers 11. A passageway 5 is formed between the opening 21 of the front portion and the rear portion of the chassis 2 and the space formed between the two rollers 11, thereby allowing the knife mold or the punch mold plate 6 to pass therethrough. The bottom cover 3 encloses the lower portion of the roller mechanism 1. The bottom cover 3 also fastens the roller mechanism 1 to the chassis 2. The two bridges 4 are then assembled to the front portion and the rear portion of the chassis 2, wherein the front and the rear portions of the chassis 2 include a guiding groove 22 vertically formed thereon. The two bridges 4 include a locking piece 23 relative to the guiding groove 22, thereby assembling the bridges 4 to the chassis 2. Since the bridges 4 and the chassis 2 use the guiding groove 22 and the locking piece 23 to connect with each other, the bridges 4 are detachable to reduce the storage space.

Figure 2:
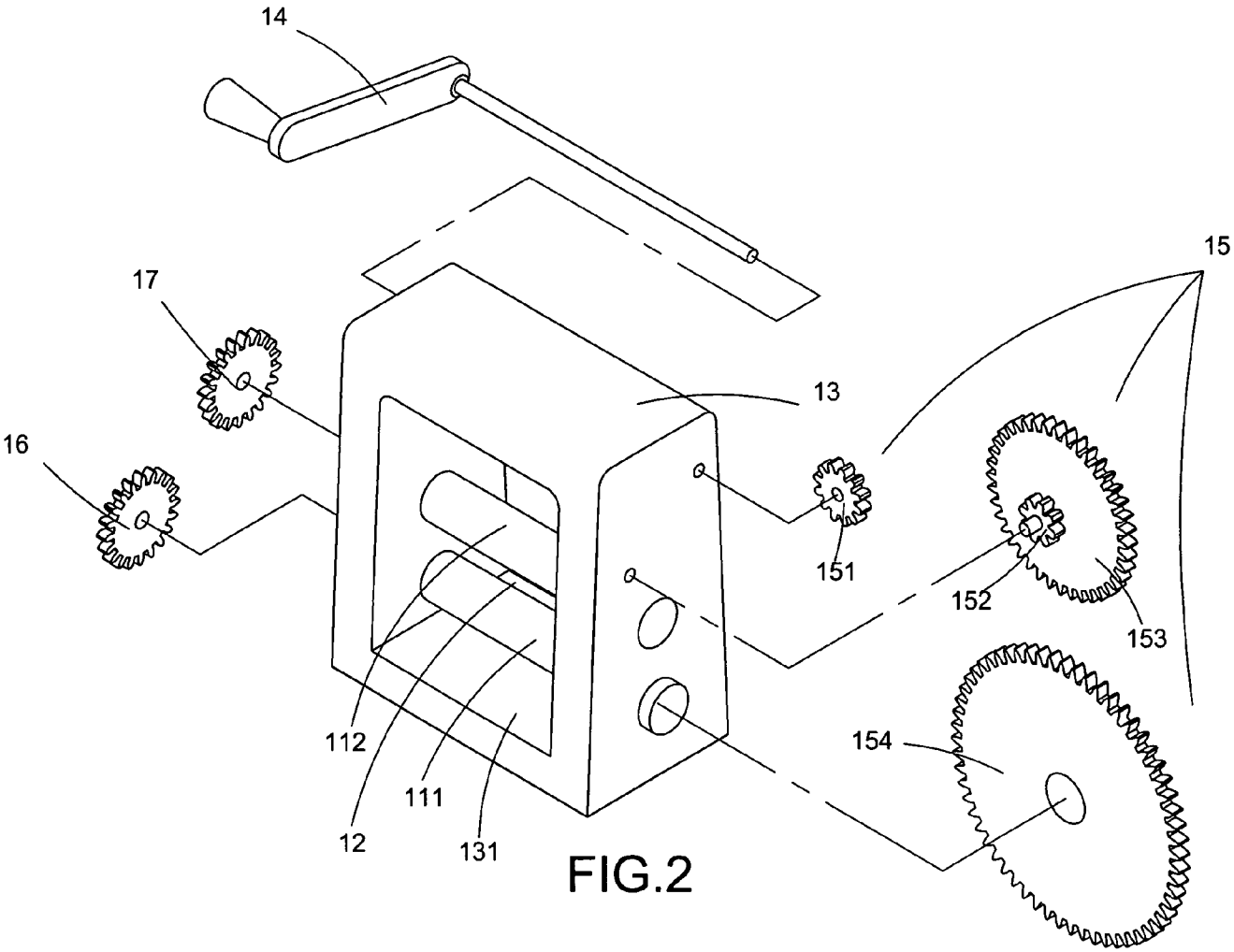
FIG. 2 is an explosive view illustrating a roller mechanism of the roller mold press in accordance with one preferred embodiment of the present invention.

Referring to FIG. 2, the roller mechanism 1 of the roller mold press of the present invention is illustrated. As shown, the roller mechanism 1 includes a static station 13, a rotating element 14, a transmission gear set 15, a first passive gear 16 and a second passive gear 17. The static station 13 includes an empty space 131 penetrated through the static station 13. The two rollers 11 are inserted to the two side walls of the static station 13. The rotating element 14 is installed at one side of the static station 13.

Figure 4:
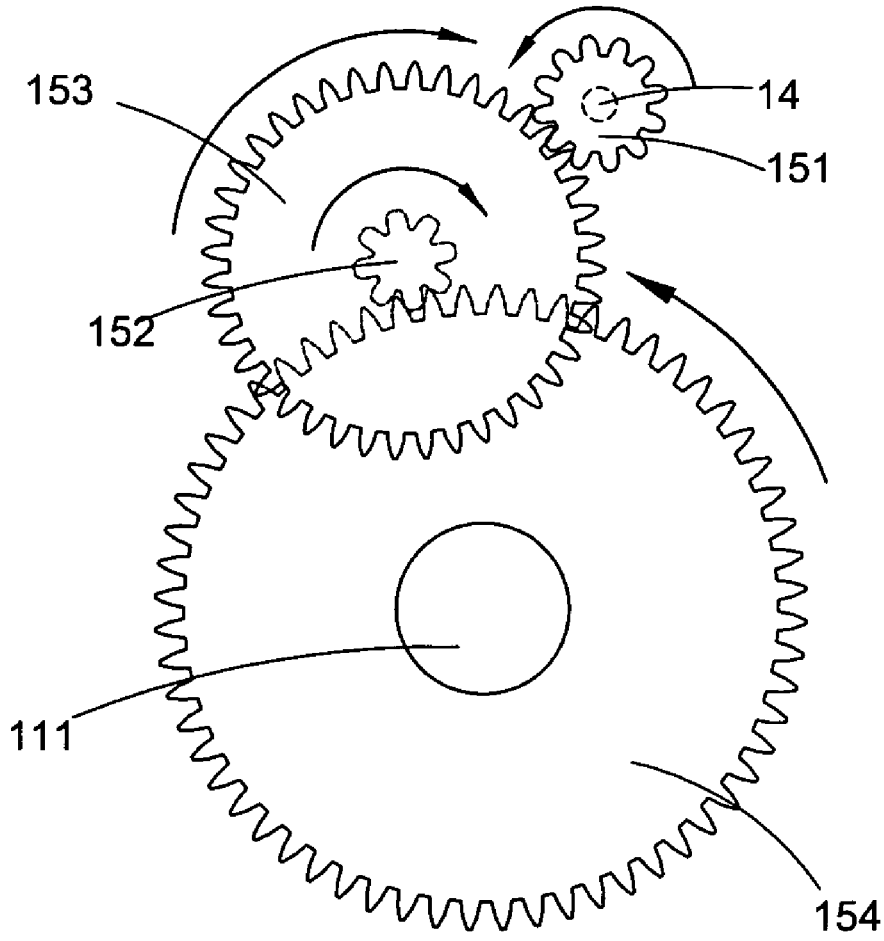
FIG. 4 illustrates the transmission process of a transmission gear set in accordance with one preferred embodiment of the present invention.

As shown in FIG. 4, the transmission gear set 15 includes two small gears 151, 152 and two large gears 153, 154. The small gear 151 is the initial transmission gear. The large gear 154 is the terminal transmission gear. The other small gear 152 and the other large gear 153 is a composite gear which rotates about the same axis. These gears compose gear set 15. The small gear 151 is engaged with the rotating element 14. The large gear 154 is engaged with the first roller 111. By turning the rotating element 14, one can drive the transmission gear set 15 and the first roller 111 to rotate. The small gears 151, 152 drive the large gears 153, 154 to rotate, thereby reducing the required driving force.

Figure 5:
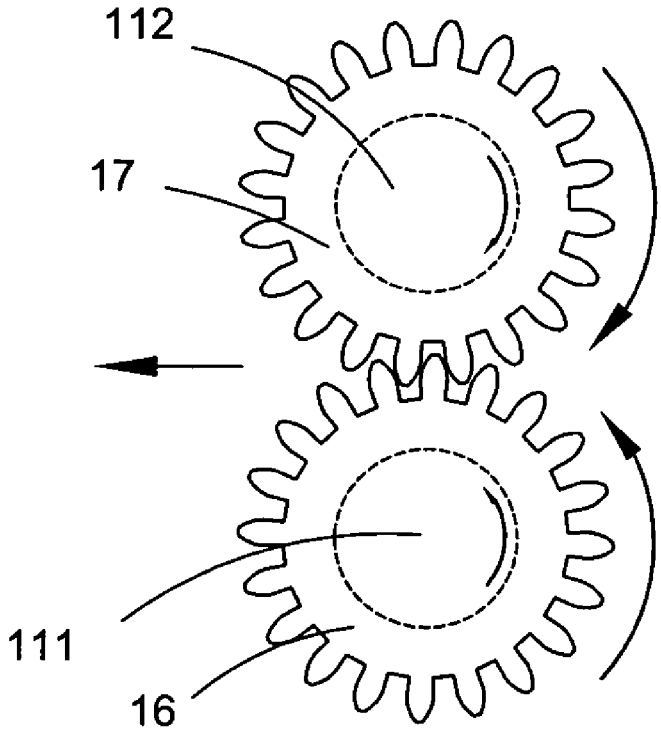
FIG. 5 illustrates the transmission process of a passive gear set in accordance with one preferred embodiment of the present invention.
Figure 6:
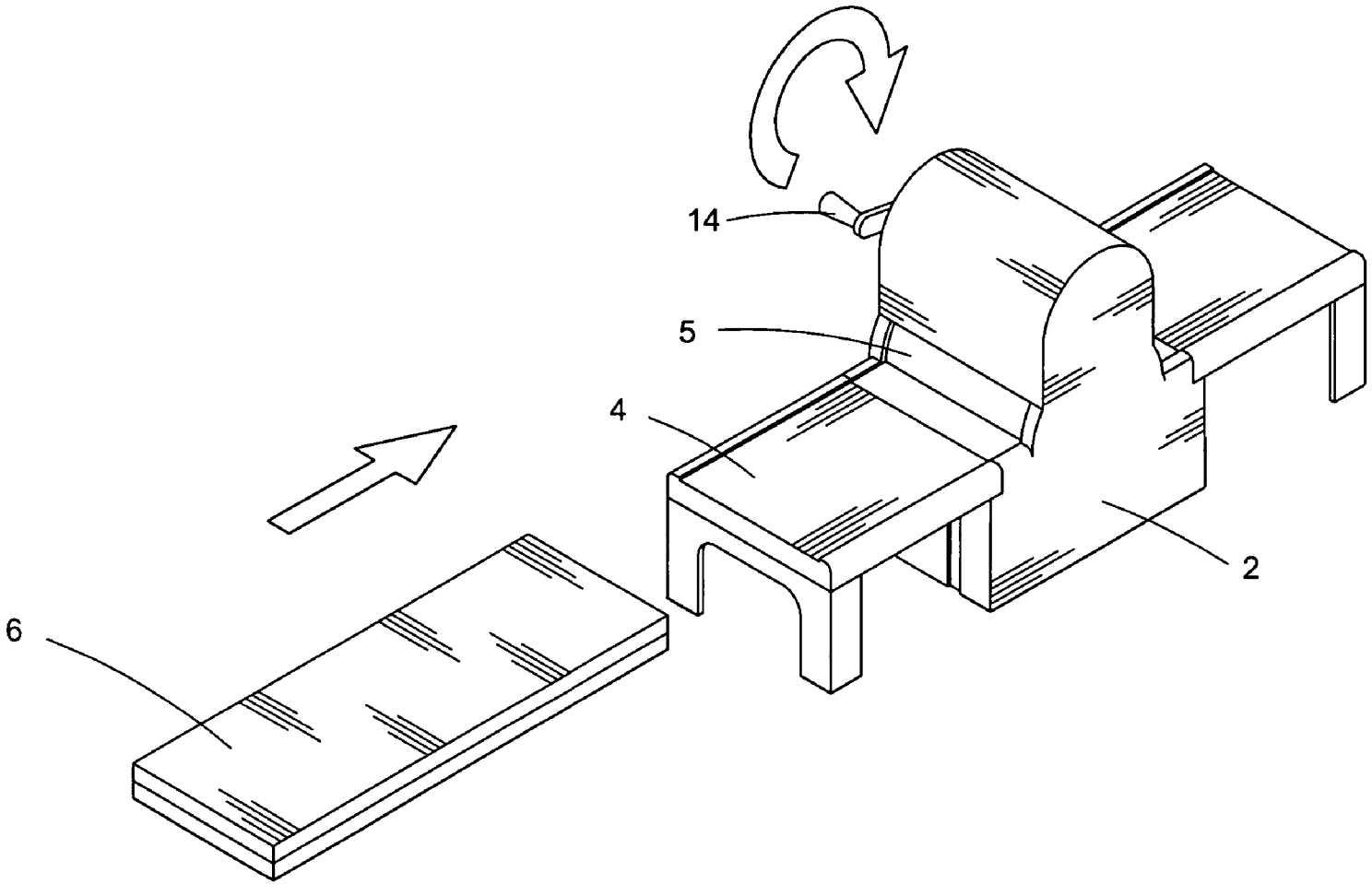
FIG. 6 illustrates the operation of the roller mold press in accordance with one preferred embodiment of the present invention.

The first passive gear 16 and the second passive gear 17 are disposed on the other side of the static station 13. The first passive gear 16 is engaged with the first roller 111 and the second passive gear 17. The second passive gear 17 is engaged with the second roller 112, as shown in FIG. 5. In this particular embodiment, the first passive gear 16 and the second passive gear 17 have the same gear radius and the same number of teeth, whereby the first the first roller 111 and the second roller 112 can rotate in the same speed, as shown in FIG. 6.

By persistently turning the rotating element 14, the transmission gear set 15 can drive the first roller 111 and the second roller 112 to rotate in a constant speed, thereby driving the knife mold or the punch mold plate 6 to move forward continuously. In other words, the length of the knife mold or the punch mold plate 6 is not restricted, which can continuously cut, carve and engrave on the working material. Meanwhile, since the transmission gear set 15 can reduce the required driving force, the thickness difference of the knife mold or the punch mold plate 6 will not affect the result of cutting and press.

While the invention has been described by means of specific embodiments, numerous modifications and variations could be made thereto by those skilled in the art without departing from the scope and spirit of the invention set forth in the following claims.

What is claimed is:

1. A detachable roller mold press, comprising:

a roller mechanism comprising a first roller and a second roller, the first roller and the second roller having a space formed therebetween, and the two rollers rotating in opposite directions;

a chassis having a front side and a rear side covering the roller mechanism, the front side and the rear side of the chassis each having an opening formed therein, thereby forming a passageway corresponding to the space;

a bottom cover covering a lower portion of the roller mechanism, thereby securely fastening the roller mechanism on the chassis; and two bridges comprising a first and second bridge, wherein, the first bridge is assembled to the front side and the second bridge is assembled to the rear side portions of the chassis, respectively; whereby a knife mold or a punch mold plate can move forward and backward along the passageway by rotating the rollers, so as to allow the rollers to press on the knife mold or the punch mold plate.

2. The roller mold press as recited in claim 1, wherein the roller mechanism further comprises:

a static station having side walls and an empty space penetrating the static station, wherein the first roller and the second roller are disposed on the side walls of the static station;

a rotating element;

a transmission gear set disposed at one side of the static station, and having an initial transmission gear engaged with the rotating element, the transmission gear set further comprising a terminal transmission gear being engaged with the first roller, whereby the rotating element drives the transmission gear set to rotate the first roller;

a first passive gear and a second passive gear, the passive gears being disposed to the other side of the static station, the first passive gear being engaged with the first roller and the second passive gear, the second passive gear being engaged with the second roller.

3. The roller mold press as recited in claim 2, wherein the initial transmission gear, has a smaller diameter than the terminal transmission gear, and a composite gear formed from gears of different diameters which rotates about the same axis.

4. The roller mold press as recited in claim 2, wherein the first passive gear and the second passive gear have the same gear radius and the same number of teeth.

5. The roller mold press as recited in claim 1, wherein the front and the rear portions of the chassis comprises a vertically formed guiding groove, the two bridges being assembled to the guiding groove, whereby the bridges are detachably affixed to the chassis.

* * * * *